US011766869B2

(12) United States Patent
Arazaki

(10) Patent No.: US 11,766,869 B2
(45) Date of Patent: Sep. 26, 2023

(54) IMAGE PROCESSING APPARATUS AND IMAGE PROCESSING METHOD

(71) Applicant: SEIKO EPSON CORPORATION, Tokyo (JP)

(72) Inventor: Shinichi Arazaki, Suwa-gun Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 105 days.

(21) Appl. No.: 17/645,564

(22) Filed: Dec. 22, 2021

(65) Prior Publication Data

US 2022/0203690 A1 Jun. 30, 2022

(30) Foreign Application Priority Data

Dec. 25, 2020 (JP) ..... 2020-216750

(51) Int. Cl.
*B41J 2/17* (2006.01)
*B41J 2/045* (2006.01)

(52) U.S. Cl.
CPC ..... *B41J 2/1714* (2013.01); *B41J 2/04593* (2013.01); *B41J 2/04595* (2013.01)

(58) Field of Classification Search
CPC ... B41J 2/1714; B41J 2/04593; B41J 2/04595
See application file for complete search history.

(56) References Cited

U.S. PATENT DOCUMENTS

2013/0229460 A1 9/2013 Masuda

FOREIGN PATENT DOCUMENTS

JP 2011-223520 A 11/2011
JP 2013-180539 A 9/2013

*Primary Examiner* — Scott A Richmond
(74) *Attorney, Agent, or Firm* — WORKMAN NYDEGGER

(57) ABSTRACT

An image processing apparatus includes a print data generating unit that generates print data for printing an image with ink, the print data defining, for each of pixels of the image, non-formation of a dot or formation of a dot of any size of a plurality of sizes, and a mist calculating unit that calculates, based on first print data of the print data generated by the print data generating unit, a mist generation amount of the ink, in which the print data generating unit is configured to generate, when the mist generation amount exceeds a predetermined threshold value, second print data of the print data in which a formation ratio of the dot of a relatively large size among the plurality of sizes is higher than the formation ratio in the first print data of the print data.

4 Claims, 7 Drawing Sheets

40

| DOT SIZE | MIST AMOUNT RATIO | SIZE RATIO |
|---|---|---|
| SMALL DOT | 8 | 1 |
| MEDIUM DOT | 3 | 2 |
| LARGE DOT | 1 | 4 |

FIG. 5

50

| USE ORDER | DOT GENERATION RATIO TABLE |
|---|---|
| 1 | T1 |
| 2 | T2 |
| 3 | T3 |
| 4 | T4 |

FIG. 6A

51

| USE ORDER | DOT GENERATION RATIO TABLE | | | |
|---|---|---|---|---|
| | C | M | Y | K |
| 1 | T1 | T1 | T1 | T1 |
| 2 | T1 | T1 | T2 | T1 |
| 3 | T2 | T2 | T2 | T1 |
| 4 | T2 | T2 | T2 | T2 |
| 5 | T2 | T2 | T3 | T2 |
| 6 | T3 | T3 | T3 | T2 |
| 7 | T3 | T3 | T3 | T3 |
| 8 | T3 | T3 | T4 | T3 |
| 9 | T4 | T4 | T4 | T3 |
| 10 | T4 | T4 | T4 | T4 |

FIG. 6B

60

| MIST GENERATION AMOUNT | DOT GENERATION RATIO TABLE |
|---|---|
| TH1<Q≦TH2 | T2 |
| TH2<Q≦TH3 | T3 |
| TH3<Q | T4 |

FIG. 7

IMAGE PROCESSING APPARATUS AND IMAGE PROCESSING METHOD

The present application is based on, and claims priority from JP Application Serial Number 2020-216750, filed Dec. 25, 2020, the disclosure of which is hereby incorporated by reference herein in its entirety.

BACKGROUND

1. Technical Field

The present disclosure relates to an image processing apparatus and an image processing method.

2. Related Art

In an ink jet printer that performs printing by discharging dots of a liquid such as ink from nozzles, a part of the discharged ink does not land on a suitable position on a paper sheet, and then becomes mist and floats in the air. The mist adheres to the paper sheet and various locations and mechanisms inside a printer and contaminates these ones. Also, when the contaminations caused by the mist accumulate inside the printer, the operation and print quality of the printer may be affected, that is, for example, the transportation of the paper sheet becomes unstable, or the like.

A printer is known, as a related technology, that includes a mist collection device collecting mist of a liquid generated when discharging liquids from a plurality of nozzles of a discharge head (see JP 2013-180539 A).

The mist collection device is configured to suppress an adhesion of the mist to the paper sheet or the interior of the printer. In contrast, a suppression of generation of the mist as-is is also necessary to be devised.

SUMMARY

An image processing apparatus includes a print data generating unit that generates print data for printing an image with ink, the print data defining, for each of pixels of the image, non-formation of a dot or formation of a dot of any size of a plurality of sizes, and a mist calculating unit that calculates, based on first print data of the print data generated by the print data generating unit, a mist generation amount of the ink, in which the print data generating unit is configured to generate, when the mist generation amount exceeds a predetermined threshold value, second print data of the print data in which a formation ratio of the dot of a relatively large size among the plurality of sizes is higher than the formation ratio in the first print data of the print data.

An image processing method includes a print data generating step for generating print data for printing an image with ink, the print data defining, for each of pixels of the image, non-formation of a dot or formation of a dot of any size of a plurality of sizes, a mist calculation step for calculating, based on first print data of the print data generated by the print data generating unit, a mist generation amount of the ink, and a print data re-generation step for generating, when the mist generation amount exceeds a predetermined threshold value, second print data of the print data in which a formation ratio of the dot of a relatively large size among the plurality of sizes is higher than the formation ratio in the first print data of the print data.

BRIEF DESCRIPTION OF THE DRAWINGS

FIG. 5 is a diagram illustrating an example of a mist amount ratio table.

FIG. 6A is a diagram illustrating a table in which a use order of a dot generation ratio table is determined, and FIG. 6B is a diagram illustrating a table in which a use order of a dot generation ratio table is determined by ink colors.

FIG. 7 is a diagram illustrating a table determining a use dot generation ratio table depending on a mist generation amount.

DESCRIPTION OF EXEMPLARY EMBODIMENTS

Embodiments of the present disclosure will be described below by referencing the accompanying drawings. Note that each of the drawings is merely illustrative for describing the embodiments. The proportions and shapes may not be accurate, may not match one another, or some of these may be omitted due to the illustrative characteristics of the drawings.

1. APPARATUS CONFIGURATION

Figure 1:
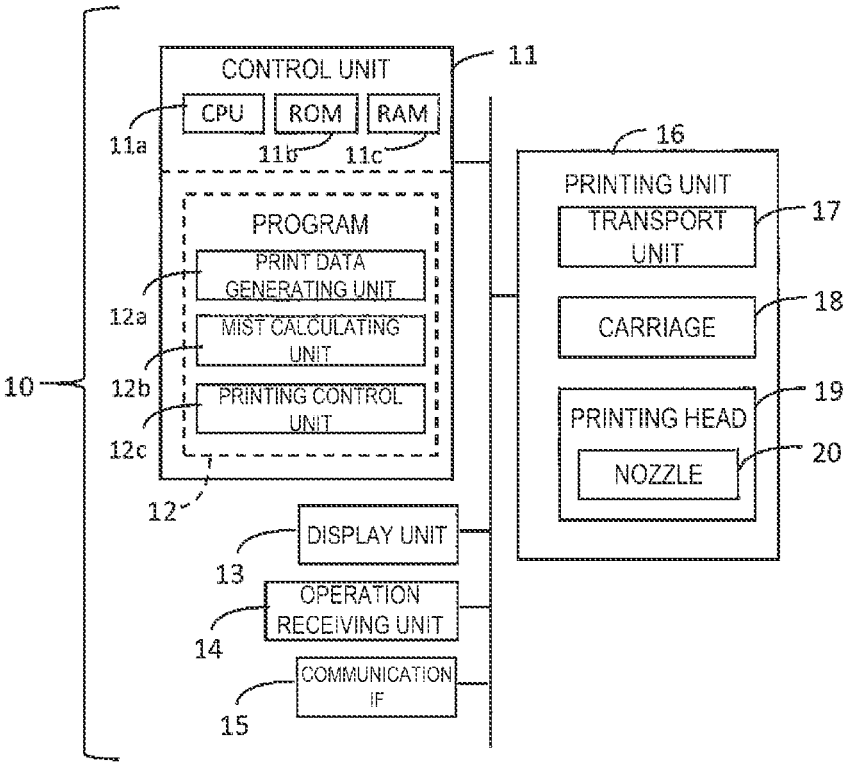
FIG. 1 is a block diagram illustrating an apparatus configuration in a simplified manner.

FIG. 1 illustrates, in a simplified manner, a configuration of a printing apparatus 10 according to the embodiment.

The printing apparatus 10 includes a control unit 11, a display unit 13, an operation receiving unit 14, a communication IF 15, a printing unit 16, and the like. The printing unit 16 includes a transport unit 17, a carriage 18, a printing head 19, and the like. The term IF is an abbreviation for interface. The control unit 11 includes one or a plurality of ICs including a CPU 11*a* as a processor, a ROM 11*b*, a RAM 11*c*, and the like, another non-volatile memory, and the like.

In the control unit 11, the processor, that is, the CPU 11*a* executes, using the RAM 11*c* or the like as a work area, arithmetic processing according to one or more programs 12 stored in the ROM 11*b*, another memory, and the like to materialize various functions such as a print data generating unit 12*a*, a mist calculating unit 12*b*, a print control unit 12*c*, and the like. At least a part of the printing apparatus 10 including the control unit 11 corresponds to an "image processing apparatus". Note that the processor is not limited to a single CPU, and a configuration may be employed in which processing is performed by a hardware circuit such as a plurality of CPUs, an ASIC, or the like, or a configuration may be employed in which the CPU performs processing in cooperation with the hardware circuit.

The display unit 13 is a means for displaying visual information, and is configured by a liquid crystal display, an organic EL display, or the like, for example. The display unit 13 may include a display and a drive circuit for driving the display. The operation receiving unit 14 is a means for receiving an operation by a user, and is materialized by a physical button, a touch panel, a computer mouse, a keyboard, or the like, for example. It goes without saying that the touch panel may be materialized as a function of the display unit 13.

The display unit 13 and the operation receiving unit 14 may be a part of the configuration of the printing apparatus 10, or may be a peripheral device externally coupled to the printing apparatus 10. The communication IF 15 is a generic term used for one or a plurality of IFs for coupling the printing apparatus 10 with the outside in a wired or wireless communication, in compliance with a predetermined communication protocol including a known communication standard.

The printing unit 16 is a mechanism by which printing is performed by an ink jet scheme. The transport unit 17 is a means for transporting the print medium such as a paper sheet in a predetermined transport direction, which includes a roller and a motor for rotating the roller and the like. The printing head 19 includes a plurality of nozzles 20. The printing head 19 performs printing of an image on the print medium by discharging or non-discharging dots of ink through the nozzles 20 based on print data, generated by the control unit 11, by which printing of the image is performed with ink. The printing head 19 is configured to discharge a plurality of colors of ink, such as cyan (C), magenta (M), yellow (Y), black (K), and the like, for example. It goes without saying that the printing head 19 may be configured to discharge ink or a liquid having a color other than the CMYK.

The carriage 18 is a mechanism configured to reciprocatively move along a predetermined main scanning direction by receiving a power from a non-illustrated carriage motor. The main scanning direction intersects the transport direction. The intersection herein referred to may be understood as orthogonal or substantially orthogonal. The printing head 19 is mounted on the carriage 18. That is, the printing head 19 reciprocatively moves along the main scanning direction together with the carriage 18.

Figure 2:
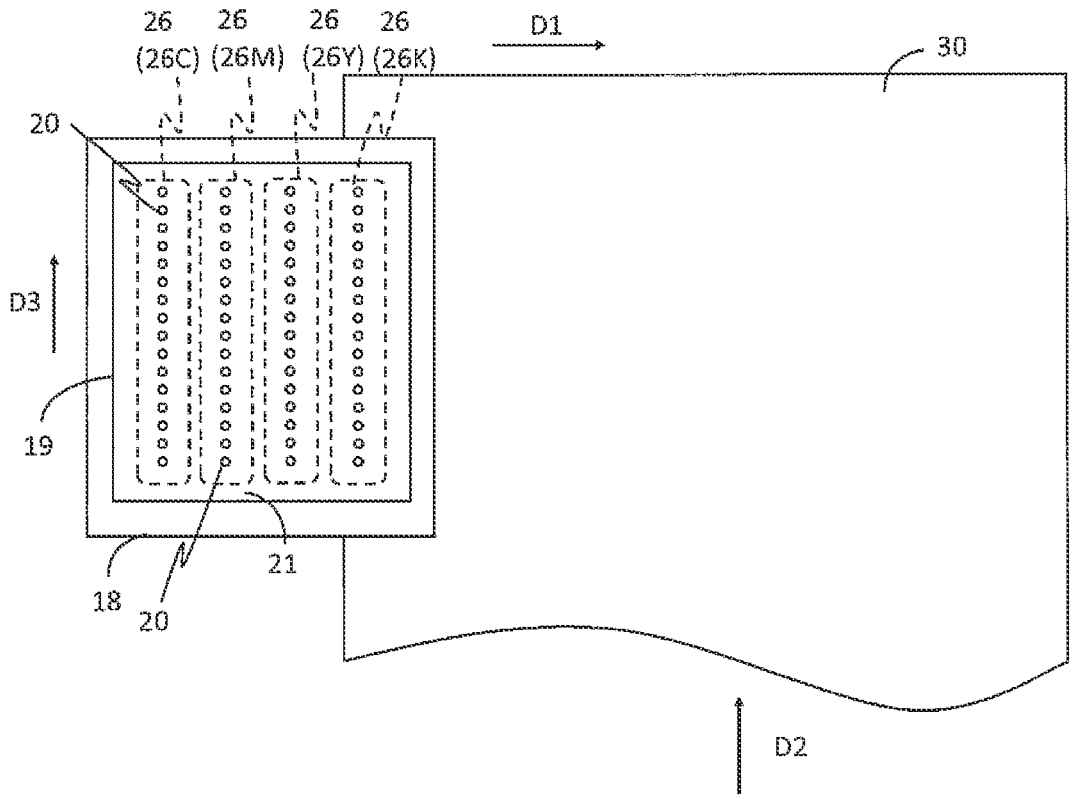
FIG. 2 is a view illustrating, from a viewpoint from above, a relationship between a print medium and a printing head.

FIG. 2 illustrates in a simplified manner from a viewpoint from above, a relationship between a print medium 30 and the printing head 19. The printing head 19 mounted on the carriage 18 is configured to move, together with the carriage 18, from one end to the other end in a main scanning direction D1 (a forward movement) and from the other end to the one end (a backward movement).

In FIG. 2, an example is illustrated of an array of the nozzles 20 at a nozzle surface 21. The nozzle surface 21 is a lower surface of the printing head 19. Every single one of the small circles within the nozzle surface 21 represents the nozzle 20. The printing head 19 includes a plurality of nozzle rows 26 by ink colors in a configuration in which each color of the ink is discharged through the nozzles 20 after being supplied from a non-illustrated liquid container means that is named as an ink cartridge, an ink tank, or the like. FIG. 2 is an example of the printing head 19 configured to discharge CMYK ink. The nozzle row 26 including the nozzles 20 that discharge the C ink is a nozzle row 26C. Similarly, the nozzle row 26 including the nozzles 20 that discharge the M ink is a nozzle row 26M, the nozzle row 26 including the nozzles 20 that discharge the Y ink is a nozzle row 26Y, and the nozzle row 26 including the nozzles 20 that discharge the K ink is a nozzle row 26K. The nozzle rows 26C, 26M, 26Y, and 26K are aligned along the main scanning direction D1.

Each of the nozzle rows 26 is constituted by the plurality of nozzles 20 for which a nozzle pitch, which is the distance between the respective nozzles 20 in a transport direction D2, is regarded as constant or substantially constant. The direction in which the plurality of nozzles 20 constituting the nozzle row 26 are aligned is a nozzle row direction D3. In the example illustrated in FIG. 2, the nozzle row direction D3 is parallel to the transport direction D2. In a configuration in which the nozzle row direction D3 is parallel to the transport direction D2, the nozzle row direction D3 is orthogonal with the main scanning direction D1. However, the nozzle row direction D3 may not be necessarily parallel to the transport direction D2, and a configuration may be employed in which the nozzle row direction D3 obliquely intersects the main scanning direction D1.

The operation of discharging ink by the printing head 19 in conjunction with the movement of the carriage 18 along the main scanning direction D1 is referred to as a main scanning or a pass. The printing unit 16 combines the pass with a fixed amount of the transport in the transport direction D2 of the print medium 30 by the transport unit 17 to complete printing onto the print medium 30.

The configuration of the printing apparatus 10 illustrated in FIG. 1 may be materialized by a single printer, or may be materialized by a plurality of mutually communicatively connected devices.

That is, the printing apparatus 10 may actually be a printing system 10. The printing system 10 includes the "image processing apparatus" that functions as the control unit 11, and a printer corresponding to the printing unit 16, for example. A image processing method of the embodiment is materialized by the printing apparatus 10 or the printing system 10 thus configured. The image processing apparatus may also be referred to as a printing control apparatus that controls the printing unit 16.

In the printing head 19, each of the nozzles 20 may be configured to discharge dots of a plurality of sizes in which a volume per droplet varies. In the structure of the printing head 19, the nozzle 20 is provided with a drive element such as a piezoelectric element. The printing head 19, by supplying drive signals corresponding to dot sizes determined in the print data to the driving elements of the nozzles 20, discharges dots of the dot sizes through the nozzles 20.

The nozzle 20 is configured to discharge two kinds of size of the dot, for example. Alternatively, the nozzle 20 is configured to discharge three or more kinds of size of the dot. In the following, it is assumed that the nozzle 20 is configured to discharge three kinds of size of the dot, which are referred to as small dot, medium dot, and large dot. As implied by the name of the dot, the small dot<the medium dot<the large dot. A dot of a certain size may be referred to as a first dot, and a dot larger in size than the first dot may be referred to as a second dot. Provided that the small dot is the first dot, the medium dot and the large dot are the second dots, for example. Also, provided that the medium dot is the first dot, the large dot is the second dot.

2. PRINT CONTROL PROCESSING

Figure 3:
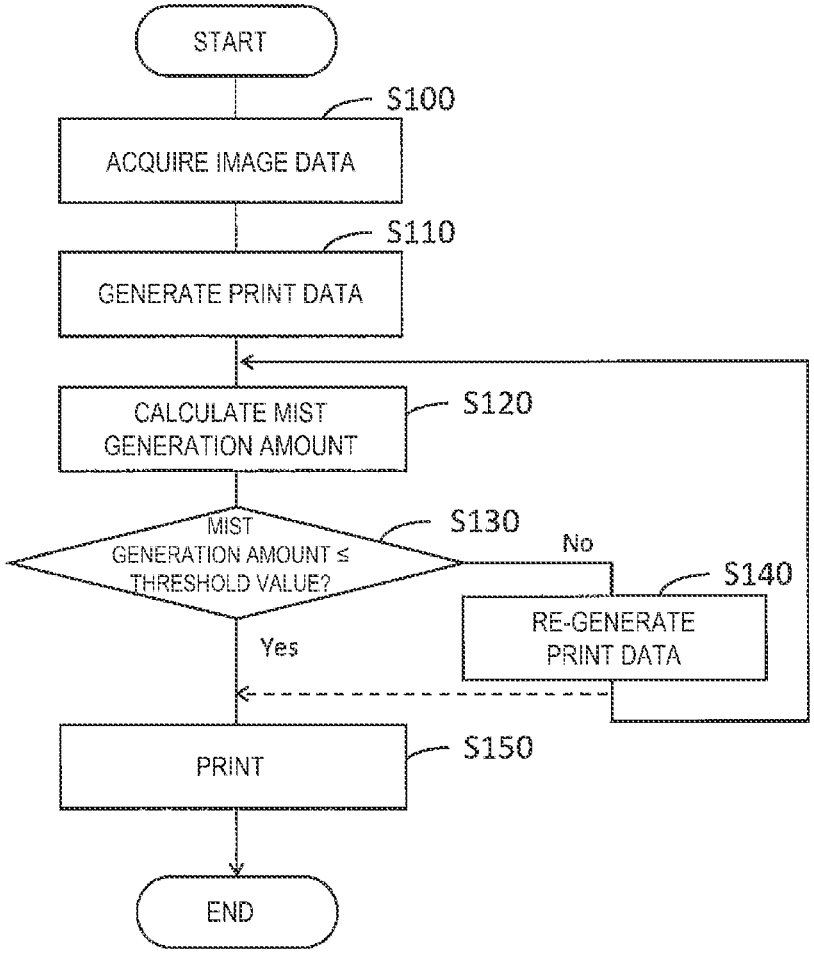
FIG. 3 is a flowchart illustrating print control processing.

FIG. 3 illustrates, by a flowchart, print control processing executed by the control unit 11 according to a program 12. The print control processing includes the image processing method.

In step S100, the print data generating unit 12*a* acquires image data representing an image of a targeted object from a storage source such as a predetermined memory or a storage device with which the control unit 11 is configured to communicate. The user can operate the operation receiving unit 14 to give a command to make the control unit 11 select the image data. It is sufficient for the control unit 11 to acquire the image data on which the command is given by the user. The image data are image data in a bitmap format determining the color of each of pixels in a predetermined color system, for example. As the color system herein referred to, there are various color systems, such as an RGB (red, green, blue) color system, a CMYK color system, and the like, for example.

In step S110, the print data generating unit 12*a* generates print data from the image data acquired in step S100. Step S110 corresponds to a "print data generation step". In this case, the print data generating unit 12*a* generates, by performing color conversion processing on the image data as necessary, image data having a gradation value for each of the CMYK ink used by the printing unit 16. The gradation value of the ink, which is expressed by 256 gradations from 0 to 255, represents a concentration of ink in a unit area of an image, for example. The print data generating unit 12*a* further converts the gradation value for each of the ink colors and each of the pixels of the image data into a generation ratio for each of the small dot, the medium dot, and the large dot, and determines, depending on the generation ratio, non-formation of the dot or formation of any one of the small dot, the medium dot, and the large dot.

The non-formation of the dot, that is, a non-discharge of the dot, is referred to as dot-off. The formation of the small dot, that is, a discharge of the small dot is referred to as a small dot-on, the formation of the medium dot is referred to as a medium dot-on, and the formation of the large dot is referred to as a large dot-on, respectively. As a result of such a step S110, the print data are generated that determine any one of the dot-off, the small dot-on, the medium dot-on, and the large dot-on for each of the ink colors and each of the pixels.

The conversion into the dot generation ratio will be described in detail.

Figure 4:
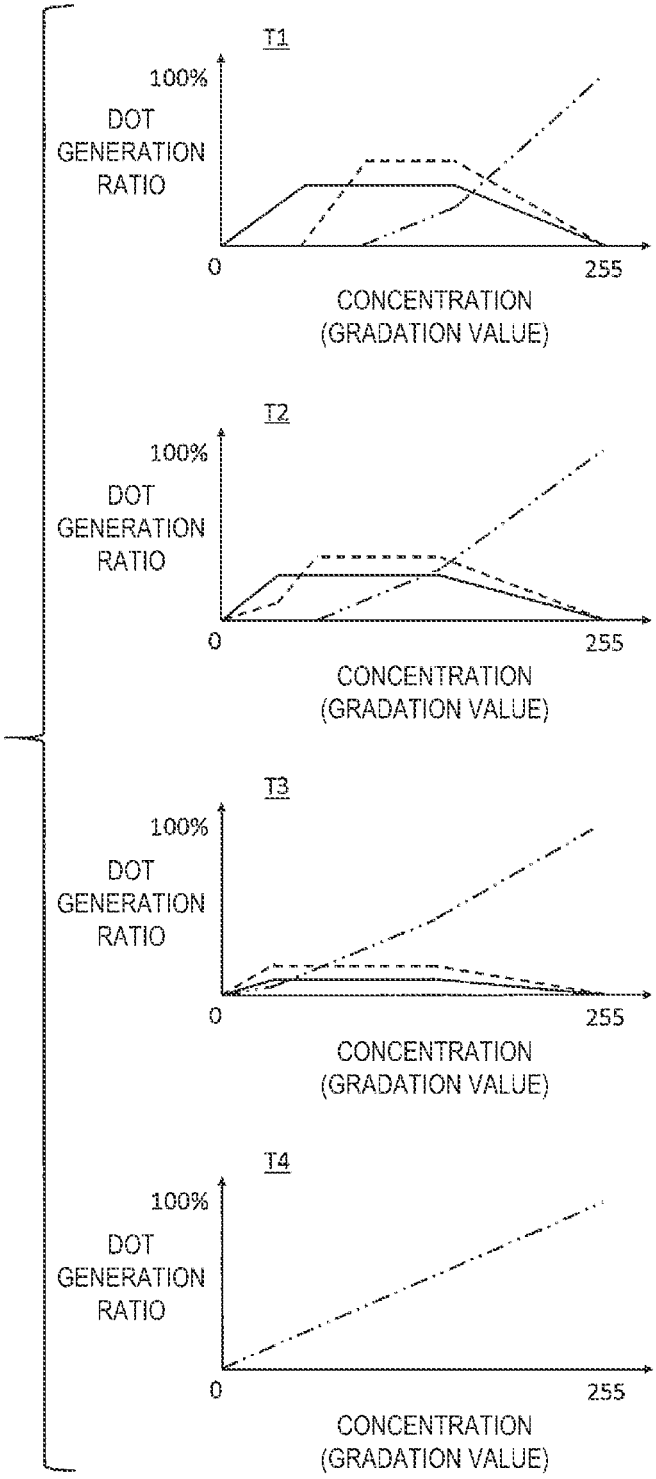
FIG. 4 is a diagram illustrating a plurality of kinds of a dot generation ratio table.

FIG. 4 illustrates dot generation ratio tables T1, T2, T3, and T4. Each of the dot generation ratio tables T1, T2, T3, and T4 is a table for converting the gradation value as the concentration of ink into the dot generation ratio. In the dot generation ratio tables T1, T2, T3, and T4, the table drawn with solid lines indicates the generation ratio of the small dot, the table drawn with dashed lines indicates the generation ratio of the medium dot, and the table drawn with dashed-two dotted lines indicates the generation ratio of the large dot. The dot generation ratio tables T1, T2, T3, and T4 are stored beforehand in a memory or the like that is accessible by the control unit 11.

The dot generation ratio tables T1, T2, T3, and T4 differ from one another in setting of the generation ratio of each of the small, medium, and large dots. Among these, the dot generation ratio table T1 is the most likely to generate the small dot, and is the most less likely to generate the large dot. The dot generation ratio table T1 is different from dot generation ratio tables T2, T3, and T4, and in a certain level of low concentration range starting from 0, only the generation ratio of the small dot is higher than 0%, while the generation ratios of the medium dot and the large dot are 0%, that is, no dots are generated, as understood from FIG. 4. Also, the dot generation ratio table T1 has the highest concentration at which the dot generation ratio of the large dot occurs among the dot generation ratio tables T1, T2, T3, and T4.

Even when printing an identical image, using more of the small dot than the large dot improves the graininess of the print result, results in the improvement of image quality. Accordingly, in terms of prioritizing the image quality, it is desirable to use the dot generation ratio table T1 among the dot generation ratio tables T1, T2, T3, and T4.

The dot generation ratio table that preferentially generates, among the dot generation ratio tables T1, T2, T3, and T4, relatively small size of dots is the dot generation ratio table T2 subsequent to the dot generation ratio table T1, as understood from FIG. 4. The dot generation ratio tables T3 and T4 causes the generation ratio of the large dot to occur in the entire concentration range starting from 0, while the dot generation ratio table T2 does not cause the dot generation ratio of the large dot to occur in the low concentration range. Also, the dot generation ratio table T2 is different in the low concentration range from the dot generation ratio table T3, and the generation ratio of the small dot is set higher than the generation ratio of the medium dot. The dot generation ratio table T4 constantly contains 0% of the generation ratios of the small dot and the medium dot, and only causes the generation ratio of the large dot to occur.

When a certain dot generation ratio table is referred to as a "first dot generation ratio table", a dot generation ratio table in which a generation ratio of the dot of a relatively large size among the plurality of sizes is set higher than the generation ratio in the first dot generation ratio table is referred to as a "second dot generation ratio table". That is, when the dot generation ratio table T1 is the first dot generation ratio table, the dot generation ratio tables T2, T3, and T4 correspond to the second dot generation ratio table. Also, when the dot generation ratio table T2 is the first dot generation ratio table, the dot generation ratio tables T3 and T4 correspond to the second dot generation ratio table. When the dot generation ratio table T3 is the first dot generation ratio table, the dot generation ratio table T4 corresponds to the second dot generation ratio table.

In step S110, the print data generating unit 12*a*, from the perspective of prioritizing the image quality, converts, using the dot generation ratio table T1, the gradation value for each of the ink colors and each of the pixels of the image data into a generation ratio for each of the small dot, the medium dot, and the large dot.

It is sufficient for the print data generating unit 12*a* to determine, in step S110 and in step S140 described later, any one of the dot-off, the small dot-on, the medium dot-on, and the large dot-on by comparing, with a threshold value, the generation ratio of each of the small dot, medium dot, and large dot, for a single ink color and a single pixel, that are derived from a dot generation ratio table. Methods for such a determination have been variously suggested. For example, when the generation ratio of the small dot is not less than a certain threshold value (a first condition is established), it may be determined as the small dot-on. Also, when the first condition is not established and the generation ratio of the medium dot is not less than a certain threshold value (a second condition is established), it may be determined as the medium dot-on, for example. Also, when the second condition is not established and the generation ratio of the large dot is not less than a certain threshold value (a third condition is established), it may be determined as the large dot-on, for example. When none of the first, second, and third conditions are established, it may be determined as the dot-off. The certain threshold values herein referred to represent threshold values that are different from one another, or partially common threshold values.

The print data generating unit 12*a* may also determine the dot-on and the dot-off for each of the ink colors under a duty limit value for a single pixel. The duty limit value represents the upper limit of amount of ink that can be discharged onto a unit area on the print medium, and it is assumed that an amount of ink equivalent to two large dots by total of all ink colors per pixel is the duty limit value, for example. In this case, the print data generating unit 12*a* determines, based on the generation ratio for each of the dot sizes, the dot-off, the small dot-on, the medium dot-on, or the large dot-on of each of the CMYK ink for a single pixel such that the duty limit value is observed.

In step S120, the mist calculating unit 12*b* calculates the mist generation amount of ink based on the print data generated by the print data generating unit 12*a*. The mist calculating unit 12*b*, in step S120 executed subsequent to step S110, calculates the mist generation amount based on the print data generated in step S110, and in step S120 executed subsequent to step S140, calculates the mist generation amount based on the print data generated in step S140. The step S120 corresponds to a "mist calculation step".

FIG. 5 illustrates an example of a mist amount ratio table 40. The mist amount ratio table 40, as well as tables 50, 51, and 60 described later are stored beforehand in a memory or the like that is accessible by the control unit 11. The mist amount ratio table 40 determines a mist amount ratio and a size ratio for each of the dot that are different in size. The size ratio represents a size ratio of a single droplet of each of the medium dot and the large dot, provided that the size of a single droplet of the small dot is 1. The size ratio may also be referred to as a volume ratio. According to the mist amount ratio table 40, the size of the medium dot is twice the size of the small dot, and the size of the large dot is four times the size of the small dot.

The mist amount ratio represents a ratio of an amount of mist generated by discharge of a single droplet of each of the small dot and the medium dot, provided that the mist generation amount by discharge of the large dot of a single droplet is determined as 1. More amount of the mist is generated when small size of dots are discharged than when large size of dots are discharged. This is because the small dot tends to be discharged at a slower rate than the large dot through the nozzle 20, which increases the amount of ink that fails to land on the print medium. Also, the amount of mist simply increases as the number of times of discharge of the dots through the nozzles 20 increases. According to the mist amount ratio table 40, four droplets of the small dot need to be discharged in order to ensure the same amount of ink as when one droplet of the large dot is discharged. Accordingly, a large amount of the mist is more generated as the small dot is more used. According to the mist amount ratio table 40, the amount of mist generated by discharge of the medium dot is three times the amount of mist generated by discharge of the large dot, and the amount of mist generated by discharge of the small dot is eight times the amount of mist generated by discharge of the large dot.

The mist calculating unit 12*b* analyzes the print data, and aggregates the number of each of the small dot, the medium dot, and the large dot that are determined in the print data. The number of the dots represents the sum of the number of the small dot-on of the C ink, the number of the small dot-on of the M ink, the number of the small dot-on of the Y ink, and the number of the small dot-on of the K ink. Similarly, the number of the medium dot represents the sum of the number of the medium dot-on of each of the CMYK ink, and the number of the large dot-on represents the sum of the number of the large dot-on of each of the CMYK ink. The mist calculating unit 12*b* is configured to designate, as the mist generation amount, the sum of the value obtained by multiplying the number of the small dot and the mist amount ratio of the small dot determined by the mist amount ratio table 40, the value obtained by multiplying the number of the medium dot and the mist amount ratio of the medium dot determined by the mist amount ratio table 40, and the value obtained by multiplying the number of the large dot and the mist amount ratio of the large dot determined by the mist amount ratio table 40. Such a calculation of the mist generation amount in step S120 is an estimation of the mist generation amount.

Note that the mist calculating unit 12*b*, in step S120, calculates the mist generation amount for the print data for a predetermined print area. The print data for the predetermined print area are print data for one page of the image data, for example. Alternatively, the mist calculating unit 12*b*, in step S120, may calculate the mist generation amount for the print data for a predetermined print time. In the printing unit 16, a pass time is determined that is required from the start timing of a single pass to the start timing of the subsequent pass. Thus, the mist calculating unit 12*b* may calculate the mist generation amount for the print data to be printed in N pass times.

The print data generating unit 12*a*, in step S130, determines whether the mist generation amount calculated in step S120 is not greater than a predetermined threshold value (a mist threshold value) set for the comparison with the mist generation amount. The mist threshold value represents the upper limit of the mist generation amount that is acceptable for prioritizing the image quality such as granularity. Although not particularly illustrated in FIG. 1, the printing apparatus 10 may include a mechanism for recovering the generated mist, such as mist collection equipment in JP 2013-180539 A, for example. The mist threshold value is determined in further consideration of recovery capacity of the recovery mechanism when providing such a mist recovery mechanism.

The print data generating unit 12*a*, provided that the mist generation amount is not greater than the mist threshold value, proceeds from the determination of "Yes" to step S150. In contrast, the print data generating unit 12*a*, when the mist generation amount exceeds the mist threshold value, proceeds from the determination of "No" to step S140.

In step S140, the print data generating unit 12*a* regenerates the print data. However, the color conversion processing of the image data has been executed in step S110, thus in step S140, it is sufficient, in steps for generating the print data described in step S110, to start over again from the processing of converting into the generation ratio for each of the small dot, the medium dot, and the large dot by applying the dot generation ratio table to the image data having the gradation value for each of the ink colors and for each of the pixels. In step S140, the print data generating unit 12*a* converts the concentration of ink into the generation ratio for each of the small dot, the medium dot, and the large dot by using the second dot generation ratio table when the dot generation ratio table used in the "most previous print data generation" is designated as the first dot generation ratio table.

In case where the present step S140 is the step S140 firstly executed after step S110, step S110 is the most previous print data generation. In contrast, in case where the present step S140 is the step S140 secondly and subsequently executed after step S110, the previous step S140 is the most previous print data generation. The print data generated in the most previous print data generation corresponds to "first print data". Then, the print data generated in the present step S140 corresponds to "second print data". The second print data are print data in which the dot-on ratio of larger dot is higher than the dot-on ratio among the small, medium, and large dots in the first print data. That is, the second print data are print data in which a formation ratio of the dot of the relatively large size among the plurality of sizes is higher than the formation ratio in the first print data.

FIG. 6A illustrates a use order table 50 in which the use order of the dot generation ratio table is determined. The print data generating unit 12*a* may determine a dot generation ratio table used in step S140 by referencing the use order table 50. The dot generation ratio table T1 of the use order=1 has already been used in step S110, thus any one of the dot generation ratio tables T2, T3, and T4 when and after the use order=2 is used in step S140. That is, in case of step S140 firstly executed after step S110, the dot generation ratio table T2 of the use order=2 is used. Also, in case of step S140 secondly executed after step S110, the dot generation ratio table T3 of the use order=3 is used.

Such a step S140 corresponds to a "print data re-generation step". After step S140, the control unit 11 re-executes steps S120 and S130. When steps S120 and S130 are executed after step S140, and step S140 is re-executed from "No" in step S130, the previous step S140 corresponds to the "print data generation step" and the latest step S140 corresponds to the "print data re-generation step" for the latest step S140. That is, the second print data correspond to the first print data for the subsequent step S140 having undergone "No" in step S130.

In step S150, the print control unit 12*c* transfers, to the printing unit 16, the print data from which the mist generation amount determined to be not greater than the mist threshold value in step S130 is calculated, thereby causing the printing unit 16 to perform printing based on the transferred print data. The printing unit 16, by controlling a drive of the nozzle 20 of each of the ink colors included in the printing head 19 according to information of the dots-off, the small dot-on, the medium dot-on, and the large dot-on, for each of the pixels and the ink colors, that are determined by the transferred print data, performs printing of an image expressed by the print data on the print medium 30. As a result, no mist of an amount exceeding the mist threshold value occurs when performing printing based on the print data. The flowchart illustrated in FIG. 3 ends here. It goes without saying that the control unit 11 is configured to repeatedly execute the flowchart of FIG. 3.

3. MODIFICATION EXAMPLE

The degree of influence on the granularity of an image quality varies depending on the color of ink.

First Modification Example

The degree of influence on the granularity of an image quality varies depending on the color of ink. For example, the K ink, which has the darkest color among the CMYK ink, has the greatest influence on the granularity. The large dot of the K ink shows conspicuous graininess, thus it is preferred to preferentially use a small dot as much as possible for the image quality, for example. In contrast, the Y ink, which has the lightest color among the CMYK ink, even if this is the large dot, does not show the conspicuous graininess, thus hardly deteriorates the image quality even when used heavily. Based on such a point of view, the print data generating unit 12*a*, in step S140, may separately use the dot generation ratio table depending on the ink color rather than applying an identical dot generation ratio table for all of the ink colors.

When ink of a certain color is referred to as a "first ink", ink having a higher lightness than the first ink is referred to as a "second ink". For example, provided that the K ink is the first ink, each of the CMY ink corresponds to the second ink. Also, provided that the C ink or the M ink is the first ink for example, the Y ink corresponds to the second ink, for example. Then, in the first modification example, the print data generating unit 12*a* is configured to generate the first print data by converting the concentration of each of the first ink and the second ink of the image by using the first dot generation ratio table, and to generate, when the mist generation amount exceeds the mist threshold value, the second print data by converting the concentration of the first ink by using the first dot generation ratio table and by converting the concentration of the second ink by using the second dot generation ratio table.

FIG. 6B illustrates a use order table 51 in which the use order of the dot generation ratio table is determined. In the first modification example, the print data generating unit 12*a* determines a dot generation ratio table used in step S140 by referencing the use order table 51. The use order table 51 determines, for the ink of a color having a great influence on the image quality, the use order of the dot generation ratio table by ink colors so as to use, as much as possible, the dot generation ratio table that is advantageous for the image quality. As in the description of the use order table 50, the dot generation ratio table T1 of the use order=1 has already been used for each of the CMYK ink in step S110. Accordingly, a dot generation ratio table when and after the use order=2 is used in step S140.

That is, in case of step S140 firstly executed after step S110, the print data generating unit 12*a*, according to the use order table 51 of the use order=2, uses the dot generation ratio table T1 for the conversion of the concentration of each of the CMK ink into a dot generation ratio, and uses the dot generation ratio table T2 for the conversion of the concentration of the Y ink into a dot generation ratio. In this case, a use of the dot generation ratio table T2 for the Y ink makes it possible to reduce the mist generation amount compared to the most previous print data generation. Also, in case of step S140 secondly executed after step S110, the print data generating unit 12*a*, according to the use order table 51 of the use order=3, uses the dot generation ratio table T1 for the conversion of the concentration of the K ink into a dot generation ratio, and uses the dot generation ratio table T2 for the conversion of the concentration of each of the CMY ink into a dot generation ratio.

In step S140 thirdly and subsequently executed after step S110 as well, the print data generating unit 12*a* references the use order table 51 to select a dot generation ratio table used for each of the ink colors, to convert the concentration into a dot generation ratio. As such, according to the first modification example, the print data generating unit 12*a* determines as "No" in step S130, and even when re-generating, in step S140, the print data in order to reduce the mist generation amount, performs control of ink of a color having a great influence on the image quality so as to prevent a large dot from being generated as much as possible.

The ink discharged from the printing unit 16 is not limited to the CMYK ink. The printing unit 16 may be a model that uses light cyan (LC) ink or light magenta (LM) ink, for example. In this case, the print data generating unit 12*a* may handle, as in the Y ink, the LC and LM ink as the second ink.

Second Modification Example

The print data generating unit 12*a*, after determining as "No" in step S130 and executing step S140, may not execute step S120 and proceed to step S150 as is, as indicated by the dashed arrow in FIG. 3. That is, a configuration may be employed in which the number of times of executing step S140 is limited to once and the printing is performed in step S150 based on the print data re-generated in step S140.

The print data generating unit 12*a*, in the configuration in which the number of times of executing step S140 is limited to once, may prepare a plurality of threshold values for comparing with the mist generation amount in step S130 and determine a dot generation ratio table used in step S140 depending on a magnitude relationship between the mist generation amount and the plurality of threshold values.

FIG. 7 illustrates a table 60 determining a correspondence relationship between the mist generation amount and the dot generation ratio table. In step S130, the print data generating unit 12*a* compares the mist generation amount calculated in step S120 with threshold values TH1, TH2, and TH3. In FIG. 7, the mist generation amount calculated in step S120 is described as "Q". The threshold value TH1 may be understood as the mist threshold value thus far described. Where TH1<TH2<TH3.

In step S130, the print data generating unit 12*a*, in case when Q≤TH1, determines as "Yes" and proceeds to step S150. In addition, the print data generating unit 12*a*, in case when TH1<Q≤TH2, references the table 60 to determine using of the dot generation ratio table T2 and proceeds to step S140. Further, the print data generating unit 12*a*, in case when TH2<Q≤TH3, references the table 60 to determine using of the dot generation ratio table T3 and proceeds to step S140, and in case when TH3<Q, references the table 60 to determine using of the dot generation ratio table T4 and proceeds to step S140.

The print data generating unit 12*a*, in step S140, generates the print data (the second print data) by converting the concentration of ink into the generation ratio of each of the small, medium, and large dots by using the dot generation ratio table determined by referencing the table 60. Then, the print control unit 12*c*, subsequent to this step S140, executes step S150. According to the second modification example as such, the processing load of the control unit 11 can be reduced by not repeating the cycle of steps S120, S130, and S140, and none the less, the mist generation amount can be suppressed when performing printing based on the print data.

It is possible for the first modification example to be combined with the second modification example. As described above, the print data generating unit 12*a*, when any one of TH1<Q≤TH2, TH2<Q≤TH3, and TH3<Q is established in step S130, determines a dot generation ratio table used in step S140 according to the table 60. In this case, a dot generation ratio table may be determined according to the table 60 for the second ink, and the dot generation ratio table T1 may also be determined to be used for the first ink in step S140 as in step S110.

4. SUMMARY

As such, according to the embodiment, the image processing apparatus includes the print data generating unit 12*a* that generates print data for printing an image with ink, the print data defining, for each of the pixels of the image, non-formation of a dot or formation of a dot of any size of a plurality of sizes, and the mist calculating unit 12*b* that calculates, based on first print data generated by the print data generating unit 12*a*, a mist generation amount of the ink. The print data generating unit 12*a* is configured to generate, when the mist generation amount exceeds a predetermined threshold value (a mist threshold value), second print data in which a formation ratio of the dot of a relatively large size among the plurality of sizes is higher than the formation ratio in the first print data.

According to the above-described configuration, the image processing apparatus is configured to generate the second print data in which an amount of mist to be generated is smaller than the first print data, when the mist generation amount calculated from the first print data generated for printing an image exceeds the mist threshold value. This makes it possible to suppress the amount of mist generated when performing printing based on the print data. That is, a printing based on the first print data will be performed when the second print data are not generated, a printing based on the second print data will be performed when the second print data are generated, and in either cases, the amount of mist generated when performing printing is small.

Also, according to the embodiment, the print data generating unit 12*a* is configured to generate the first print data by converting a concentration of ink of an image by using the first dot generation ratio table for converting the concentration of ink into a generation ratio of each of dots of the plurality of sizes, and the print data generating unit 12*a* is configured to generate, when a mist generation amount exceeds the mist threshold value, the second print data by converting the concentration of ink of the image by using the second dot generation ratio table in which a generation ratio of the dot of the large size is set higher than the generation ratio in the first dot generation ratio table, the second dot generation ratio table converting the concentration of ink into the generation ratio of each of the dots of the plurality of sizes.

According to the above-described configuration, it is possible for the print data generating unit 12*a* to easily generate the second print data by switching the dot generation ratio table from the first dot generation ratio table to the second dot generation ratio table when the mist generation amount calculated from the first print data exceeds the mist threshold value.

Also, according to the embodiment, the print data generating unit 12*a* is configured to generate the first print data by converting, by using the first dot generation ratio table, a concentration of each of first ink of the image and second ink having brightness higher than the first ink, and to generate, when the mist generation amount exceeds the mist threshold value, the second print data by converting the concentration of the first ink of an image by using the first dot generation ratio table and by converting the concentration of the second ink of the image by using the second dot generation ratio table.

According to the above-described configuration, the print data generating unit 12*a* is configured to generate, when the mist generation amount calculated from the first print data exceeds the mist threshold value, the second print data by ongoingly using the first dot generation ratio table for the first ink having a great influence on granularity and by using the second dot generation ratio table for the second ink having a small influence on granularity. This also suppresses a generation of the amount of mist while avoiding as much as possible a reduction of image quality.

Note that it goes without saying that a dot generation ratio table that is possibly used in step S110 and step S140 is not limited to the four types illustrated in FIG. 4.

Also, the method for generating print data defining, for each of the pixels of the image, non-formation of a dot or formation of a dot of any size of the plurality of sizes is not limited to a method using a dot generation ratio table. For example, the print data generating unit 12*a* may determine, for each of the ink colors of the pixels, any one of the dot-off, the small dot-on, the medium dot-on, and the large dot-on, depending on the magnitudes of the gradation values corresponding to the concentrations for each of the ink colors.

Also, when "No" is determined in step S130 and print data are re-generated in step S140 as well, the print data generating unit 12*a* may re-generate the print data without using a dot generation ratio table. The print data generating unit 12*a* may generate the second print data by replacing at least some of the small dots in the first print data with the medium dots of the number by which the ink amount becomes equivalent according to a size ratio between the small dot and the medium dot, and with the large dots of the number by which the ink amount becomes equivalent according to a size ratio between the small dot and the large dot, for example. Similarly, the print data generating unit 12*a* may generate the second print data by replacing at least some of the medium dots in the first print data with the large dots of the number by which the ink amount becomes equivalent according to a size ratio between the medium dot and the large dot.

This embodiment discloses an image processing apparatus, a printing apparatus, and a printing system. Moreover, the embodiment discloses a method that these apparatuses and systems execute, and the program 12 that causes the method to be executed by a processor.

The image processing method includes a print data generating step for generating print data for printing an image with ink, the print data defining, for each of pixels of the image, non-formation of a dot or formation of a dot of any size of a plurality of sizes, a mist calculation step for calculating, based on the first print data generated by the print data generating unit, a mist generation amount of the ink, and a print data re-generation step for generating, when the mist generation amount exceeds a predetermined threshold value (a mist threshold value), the second print data in which a formation ratio of the dot of a relatively large size among the plurality of sizes is higher than the formation ratio in the first print data of the print data.

The printing apparatus 10 may not necessarily be a so-called serial type ink jet printer thus far described, in which the printing head 19 is mounted on the carriage 18 that moves in the main scanning direction D1.

A so-called line type ink jet printer for discharging ink may be assumed, using the printing head 19 including the nozzle rows 26 for each of the ink colors, where the nozzle rows 26 extend in the main scanning direction D1 intersecting the transport direction D2 and are long enough to cover the width of the print medium 30. In the line type ink jet printer, the carriage 18 is not necessary and it is sufficient for the nozzle row direction D3 to be understood as parallel to the main scanning direction D1 rather than to the transport direction D2.

What is claimed is:

1. An image processing apparatus, comprising:

a print data generating unit that generates print data for printing an image with ink, the print data defining, for each of pixels of the image, non-formation of a dot or formation of a dot of any size of a plurality of sizes, and a mist calculating unit that calculates, based on first print data of the print data generated by the print data generating unit, a mist generation amount of the ink, wherein the print data generating unit is configured to generate, when the mist generation amount exceeds a predetermined threshold value, second print data of the print data in which a formation ratio of a dot of a relatively large size among the plurality of sizes is higher than the formation ratio in the first print data of the print data.

2. The apparatus according to claim 1, wherein the print data generating unit is configured to generate the first print data of the print data by converting a concentration of ink of the image by using a first dot generation ratio table for converting the concentration of ink into a generation ratio of each of dots of the plurality of sizes, and to generate, when the mist generation amount exceeds the threshold value, second print data of the print data by converting the concentration of ink of the image by using a second dot generation ratio table that is for converting a concentration of ink into a generation ratio of each of the dots of the plurality of sizes, and in which a generation ratio of the dot of the large size is set higher than the generation ratio in the first dot generation ratio table.

3. The apparatus according to claim 1, wherein the print data generating unit is configured to generate the first print data of the print data by converting, by using the first dot generation ratio table, a concentration of each of first ink of the image and second ink having brightness higher than the first ink, and to generate, when the mist generation amount exceeds the threshold value, second print data of the print data by converting the concentration of the first ink of the image by using the first dot generation ratio table and by converting the concentration of the second ink of the image by using the second dot generation ratio table.

4. An image processing method, comprising:

a print data generating step for generating print data for printing an image with ink, the print data defining, for each of pixels of the image, non-formation of a dot or formation of a dot of any size of a plurality of sizes;

a mist calculation step for calculating, based on first print data of the print data generated in the print data generating step, a mist generation amount of the ink, and a print data re-generation step for generating, when the mist generation amount exceeds a predetermined threshold value, second print data of the print data in which a formation ratio of a dot of a relatively large size among the plurality of sizes is higher than the formation ratio in the first print data of the print data.

* * * * *